US005757118A

United States Patent [19]

Kubo

[11] Patent Number: 5,757,118

[45] Date of Patent: May 26, 1998

[54] X-RAY IMAGE INTENSIFIER TUBE APPARATUS HAVING MAGNETIC SHIELD

[75] Inventor: Hiroshi Kubo, Utsunomiya, Japan

[73] Assignee: Kabushiki Kaisha Toshiba, Kawasaki, Japan

[21] Appl. No.: 649,296

[22] Filed: May 17, 1996

[30] Foreign Application Priority Data

May 19, 1995 [JP] Japan ..... 7-121476

[51] Int. Cl.[6] ..... H01J 31/00

[52] U.S. Cl. ..... 313/365; 313/313; 313/242; 313/479; 250/214 VT

[58] Field of Search ..... 313/479, 240, 313/242, 527, 239, 529, 313, 365, 326, 352; 250/214 VT; 315/371, 8, 85

[56] References Cited

U.S. PATENT DOCUMENTS

| | | | |
|---|---|---|---|
| 3,809,889 | 5/1974 | McBroom | 250/214 VT |
| 4,000,432 | 12/1976 | Coon et al. | 313/242 |
| 4,220,890 | 9/1980 | Beekmans | 313/240 |
| 4,245,160 | 1/1981 | Harao | 250/214 VT |
| 4,328,418 | 5/1982 | Morgan et al. | 250/214 VT |
| 4,809,309 | 2/1989 | Beekmans | 250/214 VT |
| 4,945,223 | 7/1990 | Beauzamy | 250/214 VT |
| 5,059,854 | 10/1991 | Smits | 313/524 |

FOREIGN PATENT DOCUMENTS

| | | |
|---|---|---|
| 2217798 | 9/1974 | France . |
| 50-78158 | 7/1975 | Japan . |
| 54-89470 | 7/1979 | Japan . |

*Primary Examiner*—Sandra L. O'Shea
*Assistant Examiner*—Jay M. Patidar
*Attorney, Agent, or Firm*—Cushman Darby & Cushman IP Group of Pillsbury Madison & Sutro LLP

[57] ABSTRACT

In an X-ray image intensifier tube apparatus inc-luding a cylindrical magnetic shield placed to surround the outer periphery of an X-ray image intensifier tube, a ferromagnetic thin plate is placed in front of a convex input window of a vacuum envelope and a correcting magnetic coil is placed inside the cylindrical magnetic shield to surround the input window. This structure allows an output image which is substantially free of distortion to be obtained.

7 Claims, 5 Drawing Sheets

X-RAY IMAGE INTENSIFIER TUBE APPARATUS HAVING MAGNETIC SHIELD

BACKGROUND OF THE INVENTION

1. Field of the Invention

The invention relates to an X-ray image intensifier tube, and more specifically to an X-ray image intensifier tube apparatus used for X-ray diagnosis, inspection, or the like.

2. Description of the Related Art

A conventional X-ray image intensifier tube apparatus will be described with reference to FIG. 1. An X-ray image intensifier tube 90 is placed within a cylindrical housing 91. A vacuum envelope 92 constituting the X-ray image intensifier tube 90 has an X-ray input window 93 made of a material that allows X-rays to pass through and having a convex surface. Within the envelope 92 an input screen 94 is formed on an input substrate having a convex surface and placed in direct contact with or in proximity of the rear side of the window 93. The input screen 94, which is formed of a fluorescent material layer or a photoelectric surface, converts an X-ray image received through the window 93 into a photo-electric image. Electrons forming the photo-electric image are accelerated and focused by means of a series of electrodes 95 arranged within the vacuum envelope 92, travel as indicated by dotted lines Y, and directed onto an output screen 96. The output screen 96 is formed of a material that converts the electronic image into, for example, an optical image, which is then input through an imaging lens 97 to a CCD type TV camera 98. The TV camera 98 converts the optical image into an electric signal and sends it to a CRT monitor 99, which reproduces the electric image as a display image. The image thus reproduced is utilized for X-ray diagnosis, inspection, or the like. Arrows F shown in FIG. 1 indicate magnetic lines of force associated with an external magnetic field.

An X-ray image intensifier apparatus used in X-ray diagnosis, inspection, or the like is affected by the Earth's magnetic field and a magnetic field produced by electrical equipment located near the apparatus. That is, the external magnetic field causes a rotational distortion and a twisting distortion referred to as an S-shaped distortion in an output image. To prevent such distortions, it is conventionally known to install a magnetic shield around the X-ray image intensifier tube. It is possible to place a magnetic shield of a sufficient thickness to surround the tube. However, the placement of a thick magnetic shielding member in front of the X-ray input window will cause undesired absorption or scattering of incident X-rays. It has therefore been regarded as impossible to place a magnetic shielding plate in front of the window on which X-rays are incident. As a result, external magnetic fields will enter the inside of the tube through its X-ray input window, producing the rotational distortion and S-shaped distortion in an output image.

The production of the rotational distortion and the S-shaped distortion will be described here. Magnetic lines of force passing through the input window of the X-ray image intensifier tube and photoelectric emitted from the input screen may intersect. As a result of the intersection, the Lorentz force acts on the photo-electric to bend their paths. When external magnetic lines of force are parallel to the central axis of the X-ray image intensifier tube, they have little effect on electrons emitted from the central portion of the input screen of the tube because the electronic path is parallel to the magnetic lines of force.

However, in the other area of the input screen than its central portion, since external magnetic lines of force F are directed to the surrounding magnetic shield as shown in FIG. 1 and the input window has a convex surface, the paths of electrons and the magnetic lines of force will intersect at relatively large angles. Consequently, the paths of the electrons are bent by the external magnetic fields. Therefore, a twisting distortion in the direction of rotation is produced in the entire output image. Electrons emitted from the intermediate area between the central portion and the peripheral portion of the input screen continue to intersect with the external magnetic lines of force over a longer distance than electrons emitted from the peripheral portion of the input screen. Thus, such electrons as emitted from the intermediate area are bent greatly, resulting in the S-shaped distortion in the output image.

An example of a method of eliminating such image distortions due to external magnetic fields is to place a correction electromagnetic coil for producing an inverse magnetic field to cancel out the external magnetic field. With this method, however, the external magnetic field cannot be canceled out completely unless a magnetic field produced by the electromagnetic coil is equal in magnitude but opposite in direction to the externally applied magnetic field.

In addition, an image distortion correction method is disclosed in Japanese Unexamined Patent Publication No. 2 - 210744, by which a correcting electromagnetic coil is placed around an input window, a set of magnetic field sensors are provided to detect the magnitude and direction of an external magnetic field, and detected signals are operated on to thereby control the paths of electrons in an imaging TV camera. With this method, however, magnetic field sensors, an operation unit and a control unit are required, making the apparatus complex in construction and expensive.

SUMMARY OF THE INVENTION

It is an object of the invention to provide an X-ray image intensifier tube apparatus which is simple in construction and prevents the occurrence of any distortion in an output image due to an external magnetic field.

According to an X-ray image intensifier tube apparatus of the invention, a ferromagnetic thin plate is placed in front of a convex input window of an X-ray image intensifier tube and an electromagnetic coil is provided which is magnetically coupled with a cylindrical magnetic shield surrounding the tube and placed in a region inside one end of the cylindrical magnetic shield on the side of the input window to surround the principal portion of the input window.

The ferromagnetic thin plate is made of a material or has a thickness to allow part of an external magnetic field to reach a region inside an input screen. Preferably the ferromagnetic thin plate is made of a material having an initial permeability of 1000 or more and has a thickness of 200 micrometers or less.

According to the invention, the combined use of the ferromagnetic thin plate and the electromagnetic coil produces an internal magnetic field which allows the removal of the rotational distortion and S-shaped distortion of an output image resulting from an external magnetic field that reaches the region inside the input screen.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENTS

Figure 2:
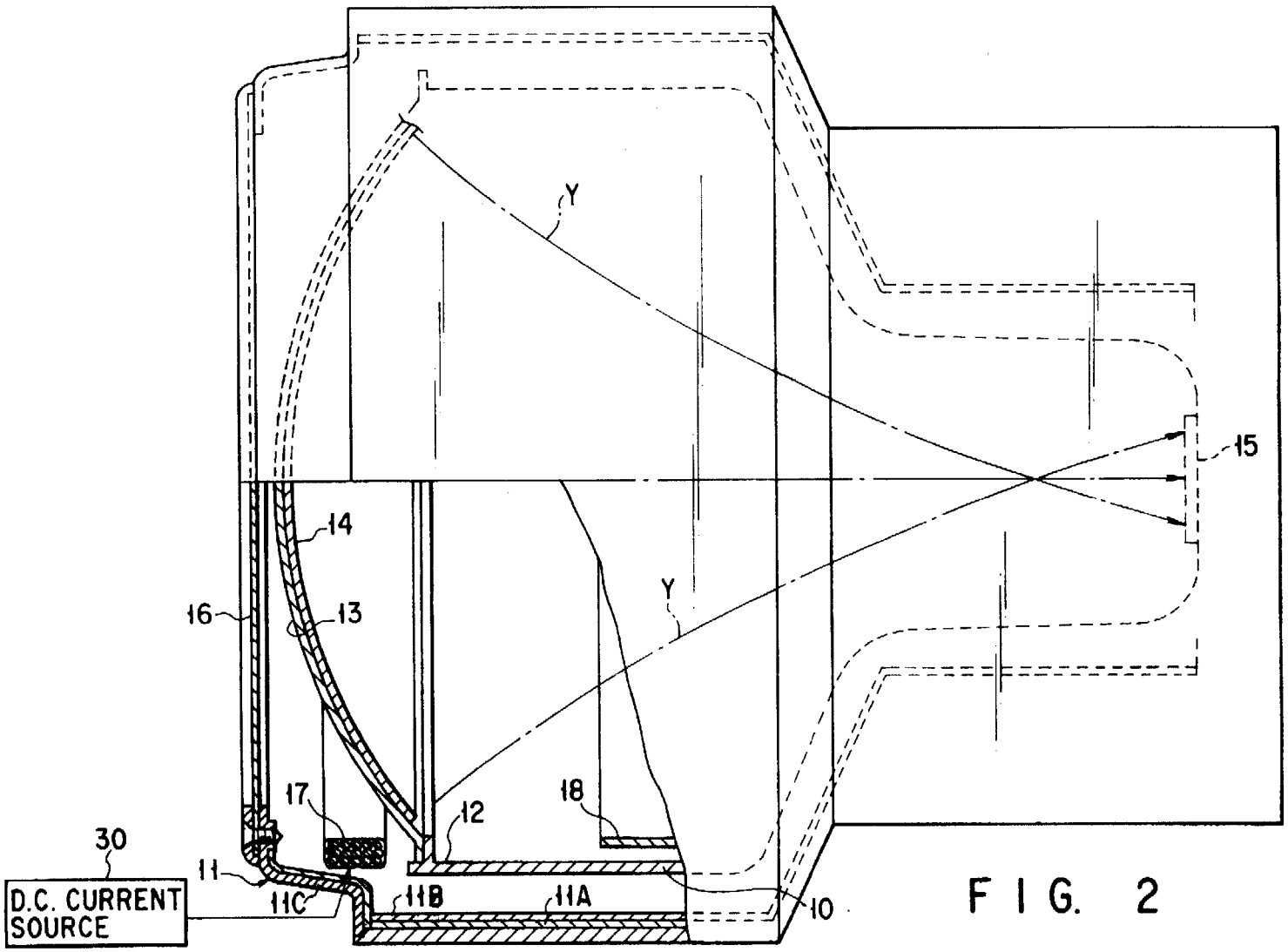
FIG. 2 is a schematic sectional view of an X-ray image intensifier tube apparatus according to an embodiment of the invention.

Referring now to FIG. 2, there is illustrated an X-ray image intensifier tube apparatus of the invention, which includes an X-ray image intensifier tube 10 that is placed within a housing 11 made of aluminum substantially in the shape of a cylinder. A vacuum envelope 12 constituting part of the tube 10 is formed at its front with a convex X-ray input window 13 of aluminum or aluminum alloy. On the rear surface of the input window 13 an input screen 14 is formed directly or with an intermediate layer interposed therebetween. The input screen has a fluorescent layer and photoelectric surface to convert an X-ray image received through the input window 13 into a photoelectric image.

At the other end of the vacuum envelope 12 an output screen 15 is provided such that it is opposed to the input screen 14. The output screen has a function of converting an electronic image into an optical or electrical image. Note that within the X-ray image intensifier tube accelerating/focusing electrodes 18 (only part of the electrodes are shown in FIG. 2) are provided to accelerate electrons and focus them onto the output screen.

The inner wall of the housing 11 is lined with an X-ray shielding plate or layer 11A and a magnetic shielding plate or layer 11B that shields external magnetic fields. Lead is used for the X-ray shielding plate 11A. The magnetic shielding plate 11B, which is made of permalloy which is a high-permeability alloy of iron and nickel, has a thickness of about 1 mm. The magnetic shielding plate 11B is placed along substantially the entire inner surface of the housing 11 from the neighborhood of the input window 13 of the tube 10 to the neighborhood of the output screen 15. Further, an input-side flange 11C, which is likewise made of permalloy and formed in the shape of a short cylinder, is secured to the opening of the housing 11 on the X-ray input side so that it surrounds the X-ray input window 13, thus constituting part of the housing. The ferromagnetic and relatively thick flange 11C is magnetically coupled with the magnetic shielding layer 11B thereby to form a cylindrical magnetic shield which surrounds the outer periphery of the X-ray image intensifier tube.

To the opening of the flange 11C is magnetically coupled and mechanically secured a ferromagnetic thin plate 16 which is made of hardened and annealed permalloy and has a thickness of about 50 micrometers. This ferromagnetic thin plate 16 is made of a material and has a thickness to allow part of the Earth's magnetic field and an external direct-current magnetic field produced by equipment located near to the apparatus to pass through the input screen 14 to the inside space region where photoelectrons travel. The ferromagnetic thin plate 16 has a flat surface region through which X-rays diverged from an X-ray point source are irradiated in an effective region of the input screen, in which the X-rays are effectively converted into a photo-electric image.

An electromagnetic coil 17 is placed in the space between the input-side end of the housing and the X-ray image intensifier tube, particularly in this embodiment, in the space between the principal portion of the input window 13 where the input screen is formed and the flange 11C as shown. The coil 17 is a coreless coil having tens of turns and is supplied by an external direct-current power supply 30 with a direct current in the range several milliamperes to hundreds of milliamperes. The electromagnetic coil 17 may be placed between that section of the barrel of the vacuum envelope 12 of the tube 10 which is near to the input screen and the housing.

The operation of the X-ray image intensifier tube apparatus thus constructed will be described below. X-rays pass through the ferromagnetic thin plate 16 and the X-ray input window 13 of the tube to reach the input screen 14. An X-ray image is converted into a photo-electric image, so that electrons forming the electronic image are emitted inside the tube as photoelectrons. The photoelectrons emitted from the input screen 14 are accelerated and focused by the focusing/accelerating electrodes 18 arranged within the vacuum envelope 12, so that they travel and impinge on the output screen 15 as indicated by arrows Y. The output screen converts the electronic image into an optical or electrical image.

In this case, by regulating the direct current applied to the electromagnetic coil 17, a high-quality output image can be obtained which is almost completely free of rotational distortion and S-shaped distortion.

Next, description will be made of the reason why a high-quality output image which is almost free of rotational distortion and S-shaped distortion can be obtained though part of an external magnetic field reaches the region inside the input screen of the tube.

Figure 5:
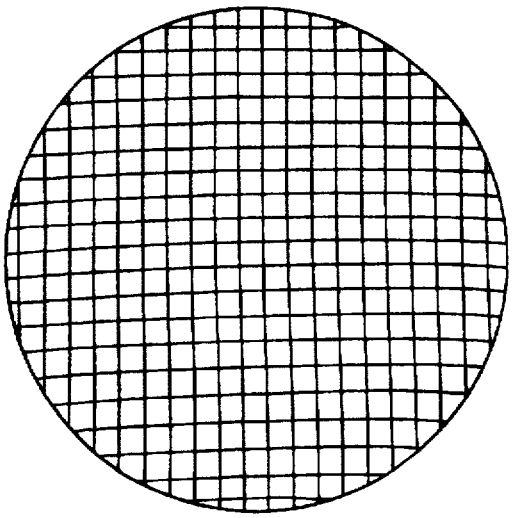
FIG. 5 is a diagram for use in explanation of an output image of an X-ray image intensifier tube.

First, for reference, an output image of the tube apparatus when no external magnetic field is present will become completely free of any distortion as shown in FIG. 5. That is, the output image of FIG. 5 corresponds to a display image on a CRT monitor for an output image of an X-ray image intensifier tube apparatus which is obtained by placing it in completely magnetically shielded indoor space and placing between an X-ray source and the X-ray input window of the X-ray image intensifier tube a pattern of a grid of lines equally spaced and intersecting at right angles. In this case, as is evident from FIG. 5, the output image has no rotational distortion and S-shaped distortion and represents the grid pattern faithfully.

Figure 1:
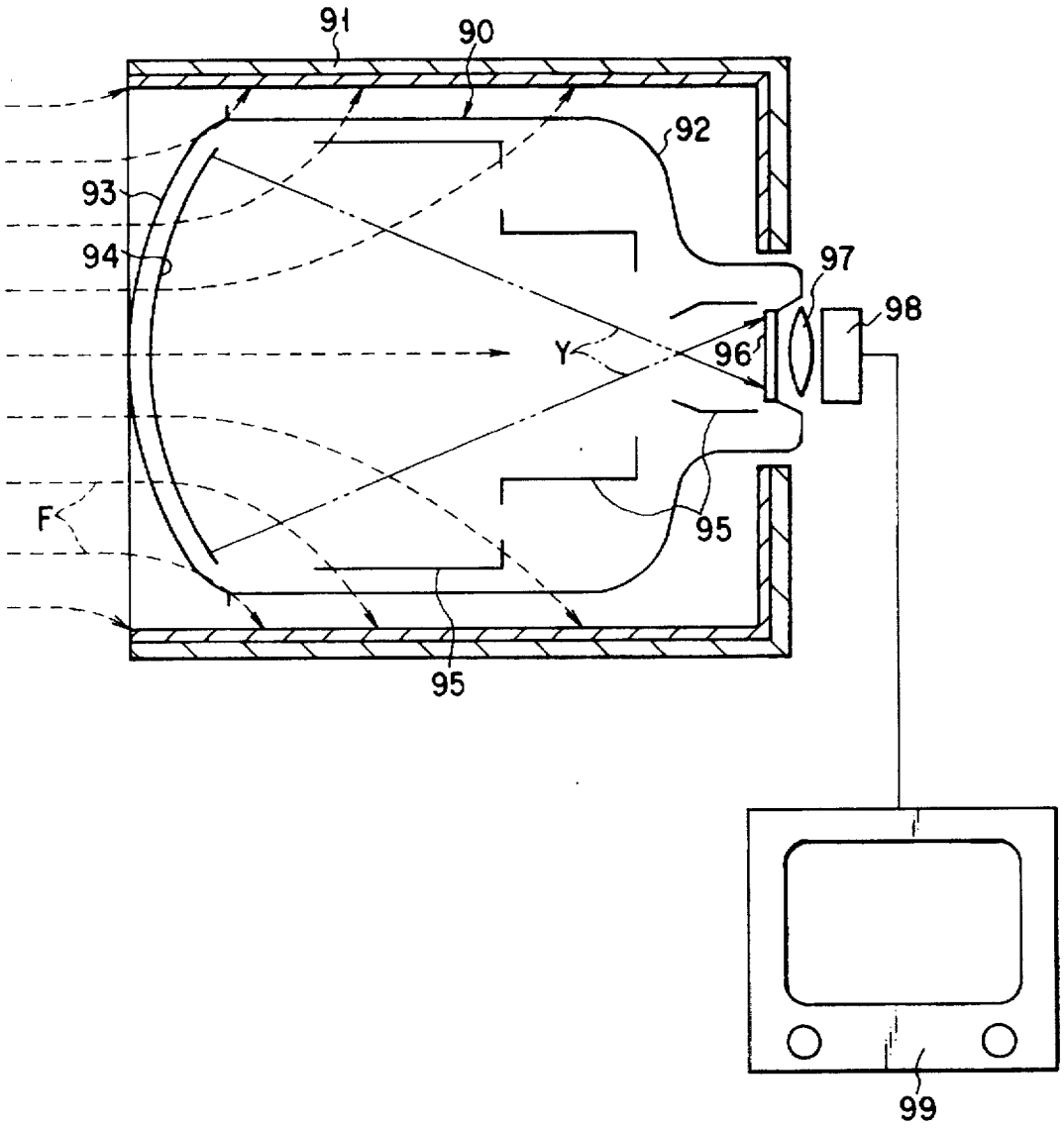
FIG. 1 (PRIOR ART)
FIG. 1 is a schematic sectional view of a conventional X-ray image intensifier tube apparatus.
Figure 6:
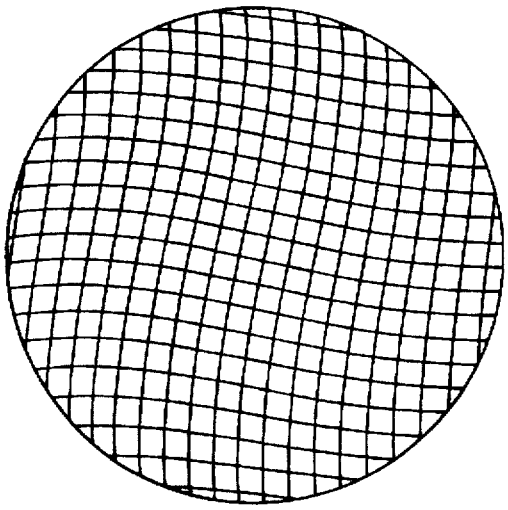
FIG. 6 is a diagram for use in explanation of image distortion that occurs in the X-ray image intensifier tube.

By way of example for comparison with the X-ray image intensifier tube apparatus of the invention, FIG. 6 shows an output image of the conventional tube apparatus shown in FIG. 1 when an external direct-current magnetic field of 1 gauss is applied in parallel with the axis of the tube. In this case, in the peripheral region of the tube the magnetic lines of force of the external magnetic field bend more toward the cylindrical magnetic shield placed to surround the tube than in the central region of the tube as indicated by F in FIG. 1. This causes a strong S-shaped distortion in the displayed grid pattern and moreover imparts a clockwise twist to the entire grid pattern.

Figure 3:
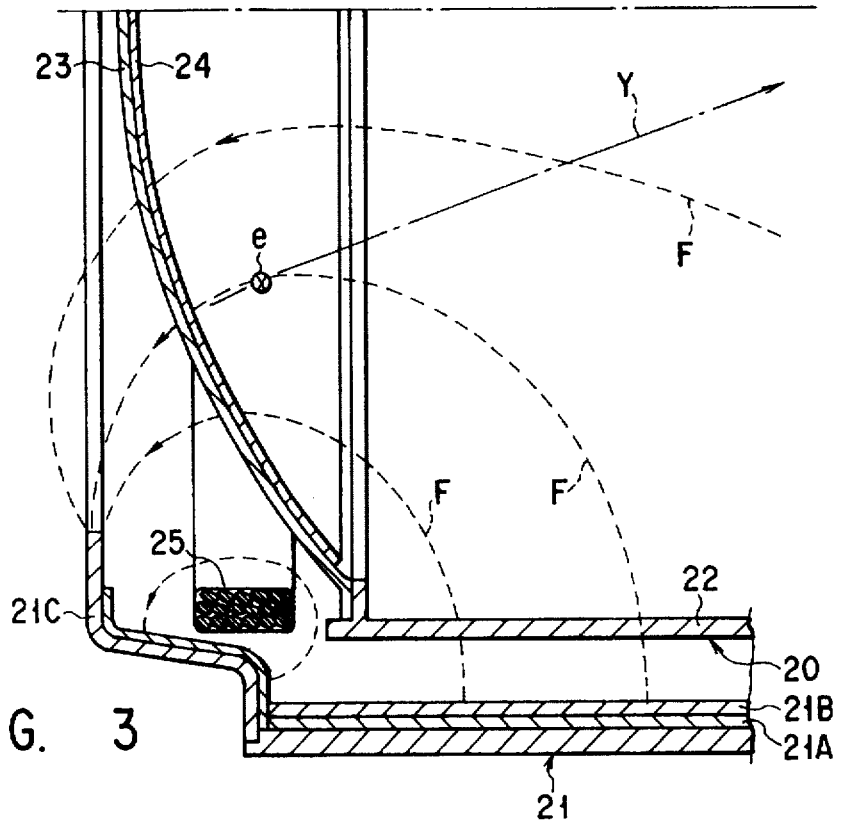
FIG. 3 is a diagram for use in explanation of the operation of the conventional X-ray image intensifier tube apparatus.
Figure 7:
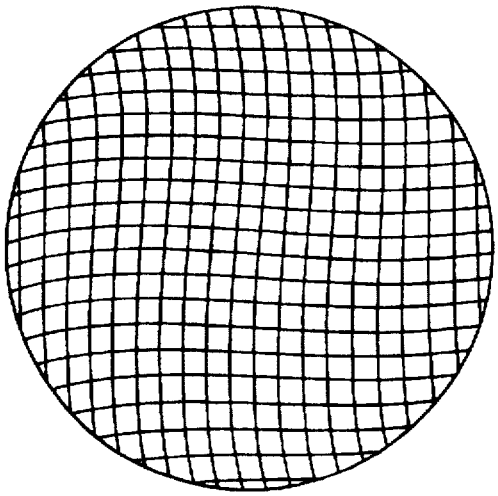
FIG. 7 is a diagram for use in explanation of image distortion that occurs in the X-ray image intensifier tube.

As another example for comparison with the tube apparatus of the invention, FIG. 7 shows an output image of the grid pattern when the conventional apparatus of FIG. 3 is supplied at its correcting electromagnetic coil with a predetermined direct current. In FIG. 3, which shows a sectional view of the input side of the lower portion of an X-ray image intensifier tube apparatus, 20 denotes an X-ray image intensifier tube, 21 denotes a housing made of aluminum, 21A denotes an X-ray shielding member, 21B denotes a magnetic shielding member, 21C denotes a flange constituting part of the housing and the X-ray shield, 23 denotes a front input window of the image tube, 24 denotes an input screen, and 25 denotes that correcting electromagnetic coil.

In the structure of FIG. 3, a direct current is applied to the electromagnetic coil 25 so that magnetic lines F of force are produced in the direction opposite to an external magnetic field. This magnetic lines of force cancels part of the external magnetic field and the resulting output image of the grid pattern becomes as shown in FIG. 7. That is, the twisting distortion is almost eliminated, but the S-shaped distortion is hardly eliminated.

Figure 8:
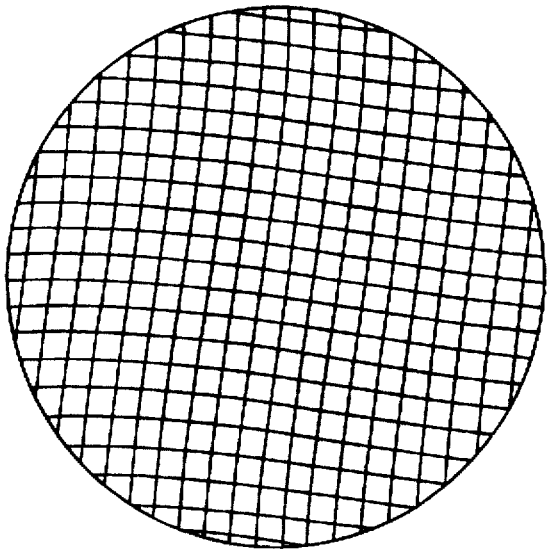
FIG. 8 is a diagram for use in explanation of image distortion that occurs in the X-ray image intensifier tube.

On the other hand, when a thin magnetic shielding plate is placed in front of the input window of the tube without the correcting electromagnetic coil, such an output image of the grid pattern as shown in FIG. 8 is obtained. As is seen from FIG. 8, the twisting distortion is hardly eliminated and the S-shaped distortion, although it is, to some degree, improved, is still produced considerably. The reason is that the magnetic shielding plate placed in front of the input window cannot completely shield the X-ray image intensifier tube from the external magnetic field.

Figure 4:
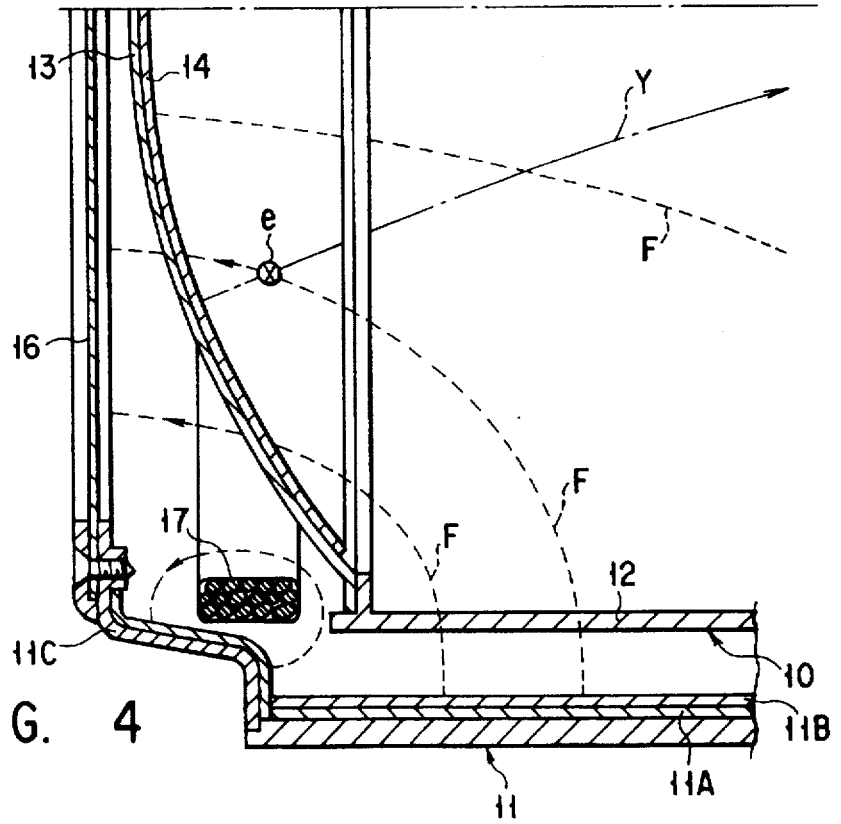
FIG. 4 is a diagram for use in explanation of the operation of the X-ray image intensifier tube apparatus of the invention shown in FIG. 2.
Figure 9:
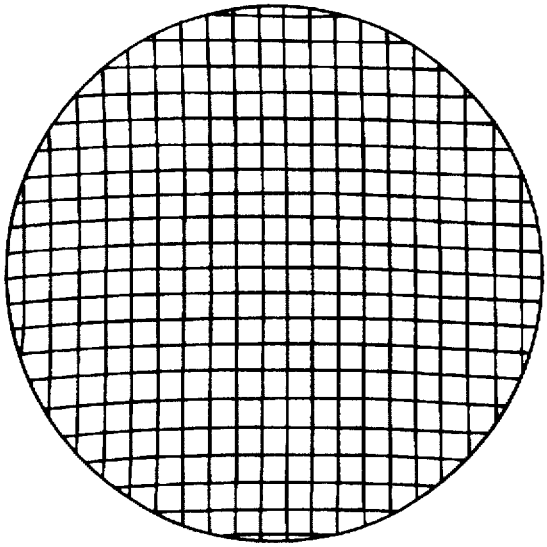
FIG. 9 illustrates an image produced by the X-ray image intensifier tube apparatus of the invention.

In contrast, according to the X-ray image intensifier tube apparatus of the invention shown in FIGS. 2 and 4, a grid pattern output image is produced which, as shown in FIG. 9, is almost completely free of a twisting distortion and an S-shaped distortion and remains almost unchanged from the output image of FIG. 5 when there is no external magnetic field. It must be particularly noted that the S-shaped distortion of the output image shown in FIG. 8 can be eliminated by the present invention. Next, the reason will be described qualitatively.

That is, the reason an S-shaped distortion is caused in an output image is that, as described previously, electrons emerged from the intermediate region of the input screen between the central and edge regions of the input screen receives from an external magnetic field the Lorentz force in the direction of rotation that is relatively great in comparison with that on electrons emerged from the central and edge regions of the input screen. It is considered that a correcting magnetic field produced by the correcting electromagnetic coil hardly acts upon the electrons emerged from the intermediate regions of the input screen in such a way as to eliminate the S-shaped distortion. The reason is that, as shown in FIG. 3, the angle of magnetic lines F of force produced by the electromagnetic coil 25 relative to the direction of motion of the electrons e emerged from the intermediate region of the input screen is small and hence the electrons e hardly receive the force in the direction of reverse rotation, i.e., in the direction to correct the S-shaped distortion, from the correcting magnetic field.

In contrast, in the present invention, the ferromagnetic thin plate 16 is provided in front of the input window 13 so that the spacing between the plate and the input window gradually increases with increasing distance from the center of the plate and the input window. Thus, the magnetic lines F of force of the correcting magnetic field produced by the correcting electromagnetic coil 17 are directed from the intermediate region of the input screen toward the ferromagnetic thin plate 16 and intersect the direction of motion of the electrons e emitted from the intermediate region of the input screen at large angles. For this reason, the electrons e receive the rotating force in the counterclockwise direction more strongly than in FIG. 3, so that the S-shaped distortion is corrected. The magnitude of the rotating force depends on the strength of the correcting magnetic field by the electromagnetic coil 17, the initial permeability, and thickness of the thin ferromagnetic plate 16. The suitable setting of these values allows the distortions of an output image to be eliminated completely.

Thus, according to the present invention, it is considered that a magnetic field component which is that part of an external magnetic field which passes through the thin ferromagnetic plate and reaches the region inside the input screen and a correcting magnetic field component which is that part of a magnetic field produced by the electromagnetic field which exists in the region inside the input screen owing to the cylindrical magnetic shield and the thin ferromagnetic plate cancel out each other to thereby remove distortions of an electronic image.

In the X-ray image intensifier tube apparatus, it is natural that the material and thickness of the ferromagnetic thin plate 16 are so selected as to make the absorption and scattering of incident X-rays by that plate and the input window 13 as small as possible and to allow part of an external magnetic field to reach the region inside the input window. Permalloy used as a material of the plate 16 in the embodiment of the invention is about 8000 in initial permeability $\mu 0$. In this case, the suitable thickness of the plate ranges from 30 to 70 micrometers for small X-ray image intensifier tubes with screens measuring nine inches and smaller and from 70 to 150 micrometers for large X-ray image intensifier tubes with screens measuring more than nine inches.

It is desirable that the ferromagnetic thin plate be so thin as to have a sufficiently high X-ray transmission factor. Thus, the initial permeability $\mu 0$ of the plate should be 1000 or more, and preferably 2000 or more, and its thickness should be 200 micrometers or less, and preferably 150 micrometers or less. Where a thin plate of ferromagnetic material is used alone, it is preferable that its thickness be selected to be 20 micrometers or more from the point of view of mechanical strength. Moreover, a ferromagnetic film may be formed over a thin plate made of, for example, plastic which little absorbs and scatters X-rays to a thickness of less than 20 micrometers.

Furthermore, where the cylindrical magnetic shield surrounding the X-ray image intensifier tube and the ferromagnetic thin plate placed in front of the tube are made of the same ferromagnetic material or similar ferromagnetic materials, or materials which are identical or similar in initial permeability, the thickness of the ferromagnetic thin plate should preferably be within a range of 1.5 to 20% of the thickness of the cylindrical magnetic shield. This will allow a distortion-free output image to be obtained.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An X-ray image intensifier tube apparatus comprising:

an X-ray image intensifier tube equipped with a vacuum envelope having at its one end an X-ray input window with a convex surface; an input screen, having a convex surface, for converting an X-ray image received through said X-ray input window into a photo-electric image; an arrangement of electrodes for accelerating and focusing electrons forming said electronic image; and an output screen for converting said electronic image into an optical or electrical output image;

a cylindrical magnetic shield placed to surround said X-ray image intensifier tube and made of a ferromagnetic material;

a thin and substantially flat plate placed in front of said input window of said tube, made of a ferromagnetic material the same as or similar to that of the cylindrical magnetic shield and having a thickness within a range of 30 to 150 micrometers which corresponds to that of 1.5 to 20% of the thickness of said cylindrical magnetic shield; and an electromagnetic coil magnetically coupled with said cylindrical magnetic shield and placed in a region inside one end of said cylindrical magnetic shield on the side of said input window to surround the principal portion of said input window of said tube.

2. The apparatus according to claim 1, wherein said ferromagnetic thin plate is made of a material or has a thickness to allow part of an external magnetic field to reach a region inside said input screen.

3. The apparatus according to claim 1, wherein said ferromagnetic thin plate is made of a material having an initial permeability of 1000 or more and a thickness of 200 micrometers or less.

4. The apparatus according to claim 1, wherein the input screen has an effective region in which the X-rays are effectively converted into the photoelectric image and the ferromagnetic thin plate have a flat region through which the X-rays diverged from an X-ray point source are irradiated on the effective region of the input screen.

5. An X-ray image intensifier tube apparatus comprising:

an X-ray image intensifier tube equipped with an X-ray image input window forming part of a vacuum envelope and having an convex surface; an input screen formed on the inner surface of said input window for converting an incident X-ray image into a photoelectric image; an arrangement of electrodes for accelerating and focusing electrons forming said electronic image; and an output screen for converting said electronic image into an optical or electrical output image;

a cylindrical magnetic shield placed to surround said X-ray image intensifier tube;

a ferromagnetic thin and substantially flat plate placed in front of said input window of said tube, said ferromagnetic thin plate and said cylindrical magnetic shield being made of the same ferromagnetic material or similar ferromagnetic materials, the thickness of said ferromagnetic thin plate being within a range of 1.5 to 20% of the thickness of said cylindrical magnetic shield; and an electromagnetic coil magnetically coupled with said cylindrical magnetic shield and placed in a region inside one end of said cylindrical magnetic shield on the side of said input window to surround the principal portion of said input window of said tube.

6. The apparatus according to claim 5, wherein said input window is made of aluminum or aluminum alloy and said ferromagnetic thin plate is made of a material having an initial permeability of 1000 or more and a thickness of 200 micrometers or less.

7. The apparatus according to claim 5, wherein the input screen has an effective region in which the X-rays are effectively converted into the photoelectric image and the ferromagnetic thin plate have a flat region through which the X-rays diverged from an X-ray point source are irradiated on the effective region of the input screen.

* * * * *